US006881115B2

(12) United States Patent
Yamamoto et al.

(10) Patent No.: US 6,881,115 B2
(45) Date of Patent: Apr. 19, 2005

(54) ELECTRON EMITTING DEVICE AND METHOD OF MANUFACTURING THE SAME

(75) Inventors: Masahiko Yamamoto, Yokohama (JP); Yoshiki Ishizuka, Tokyo (JP); Yumi Fukuda, Kawasaki (JP); Hironori Asai, Yokohama (JP); Koji Suzuki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 441 days.

(21) Appl. No.: 09/946,666

(22) Filed: Sep. 6, 2001

(65) Prior Publication Data

US 2002/0057046 A1 May 16, 2002

(30) Foreign Application Priority Data

Sep. 14, 2000 (JP) ..... 2000-280833

(51) Int. Cl.[7] ..... H01J 1/304; H01J 9/02
(52) U.S. Cl. ..... 445/24; 313/309; 445/50
(58) Field of Search ..... 445/24, 50; 313/309–311

(56) References Cited

U.S. PATENT DOCUMENTS

| | | | | |
|---|---|---|---|---|
| 5,726,524 A | | 3/1998 | Debe | |
| 5,760,536 A | * | 6/1998 | Susukida et al. | 313/311 |
| 5,844,252 A | * | 12/1998 | Shiomi et al. | 313/309 |
| 5,949,393 A | * | 9/1999 | Sakai et al. | 313/336 |
| 6,057,637 A | * | 5/2000 | Zettl et al. | 313/310 |
| 6,069,436 A | * | 5/2000 | Pryor | 313/311 |
| 6,084,340 A | * | 7/2000 | Bachmann et al. | 313/311 |
| 6,388,366 B1 | * | 5/2002 | Pryor | 313/311 |
| 6,445,114 B1 | * | 9/2002 | Kurokawa et al. | 313/336 |

FOREIGN PATENT DOCUMENTS

| | | |
|---|---|---|
| JP | 6-236731 | 8/1994 |
| JP | 7-105830 | 4/1995 |
| JP | 11-297192 | 10/1999 |
| JP | 2000-311577 | 11/2000 |
| KR | 94-20607 | 9/1994 |
| KR | 2000-0016144 | 3/2000 |

OTHER PUBLICATIONS

H. Pagnia, "Metal–insulator–metal devices with carbonaceous current paths" Int. J. Electronics, vol. 69, No. 1, 1990, pp. 33–42.

M. Bischoff,et al. "Energy distribution of emitted electrons from electroformed MIM structures: the carbon island model." Int. J. Electronics, vol. 73, No. 5, 1992, pp. 1009–1010.

M. Bischoff "Carbon–nanoslit model for the electroforming process in M–I–M structures" Int. J. Electronics, vol. 70, No. 3, 1991, pp. 491–498.

H. Pagnia, et al. "Scanning tunnelling microscopic investigations of electroformed planar metal–insulator–metal diodes" vol. 69, 1990, pp. 25–32.

* cited by examiner

*Primary Examiner*—Kenneth J. Ramsey
(74) *Attorney, Agent, or Firm*—Oblon, Spivak, McClelland, Maier & Neustadt, P.C.

(57) ABSTRACT

There is provided an electron emitting device including a substrate, a pair of electrodes formed on the substrate and being apart from each other, a pair of electrically conductive films formed on the electrodes, respectively, and being apart from each other, a distance between the electrically conductive films being shorter than a distance between the electrodes, and an electron emitting film formed between the electrically conductive films, the electron emitting film containing boron and at least one of carbon and nitrogen.

12 Claims, 4 Drawing Sheets

ELECTRON EMITTING DEVICE AND METHOD OF MANUFACTURING THE SAME

CROSS-REFERENCE TO RELATED APPLICATIONS

This application is based upon and claims the benefit of priority from the prior Japanese Patent Application 2000-280833, filed Sep. 14, 2000, the entire contents of which are incorporated herein by reference.

BACKGROUND OF THE INVENTION

1. Field of the Invention

The present invention relates to an electron emitting device applicable to a display, an exposure device or the like and a method of manufacturing the electron emitting device, and particularly relates to a cold cathode type electron emitting device having a planar structure and the method of manufacturing the device.

2. Description of the Related Art

In recent years, a cold cathode type electron emitting device having a planar structure has been proposed. This kind of device referred to as a surface conduction type device or planar type MIM device has a pair of electrodes formed at a certain interval on a flat insulating substrate, a pair of conductive films formed between these electrodes and electron emitting films formed on these conductive films. Since such an electron emitting device has a simple structure, it is suitable for forming an electron source array by arraying a large number of the devices on the same substrate.

As an application of such an electron source array, a thin type planar display now attracts attentions. This display is the one in which phosphors are made excited by electrons to emit lights similarly to a CRT. Since luminescence on the basis of such a principle has a high performance in energy efficiency, by employing the above-described electron source array, it is possible to realize a self light-emitting and thin type planar display whose power consumption is low and which displays an image with a high luminance and a high contrast.

One example of a planar type MIM device has been reported, for example, in Int. J. Electronics, 73 (1992) 1009 and Int. J. Electronics, 70 (1991) 491 by Bischoff et al., the entire contents of which are incorporated herein by reference. FIG. 1 is a perspective view schematically showing a device that Bischoff et al. has reported. The reference numeral 100 denotes an insulating substrate, the reference numerals 101*a* and 101*b* denotes metal electrodes, the reference numeral 102 denotes a metal film provided with a micro-slit, and the reference numeral 103 denotes a deposition film provided at the position of the micro-slit. Moreover, the reference numeral 105 denotes the width of a micro-slit provided to the metal film 102, and its width 105 ranges from on the order of 0.1 $\mu$m to 10 $\mu$m.

Such a structure is formed according to the following procedure. First, a pair of planar metal electrodes 101*a* and 101*b* are formed on the insulating substrate 100. Next, the metal film 102 being sufficiently thin as compared with the electrodes 101*a* and 101*b* and having a sufficient thickness for electrically conductive is formed. Next, Joule heat is generated in the metal film 102 by the passage of electric current between the electrodes 101*a* and 101*b*. Consequently, the metal film 102 is partially fused and destroyed to be discontinuous. Specifically, a micro-slit is formed in the metal film 102. It should be noted that resistance between the electrodes 101*a* and 101*b* is high immediately after the electrically conductive film is made discontinuous. Bischoff et al. refers such a procedure of making the electrically conductive film discontinuous by the current flow through the film as "B-forming (basic forming)".

The procedure referred to as "A-forming (adsorption-assisted forming)" is further performed to the structure thus formed. In the A-forming, a voltage of 20V or less is applied between the electrodes 101*a* and 101*b* in a vacuum containing hydrocarbons. Consequently, hydrocarbon molecules adsorb on the portion of the substrate 10 exposed within the micro-slit and forms the deposition film 103. As a result, the resistance between the electrodes 101*a* and 101*b* is lowered in a few minutes after the voltage application, and the electric current which flows between the electrodes 101*a* and 101*b* increases.

Bischoff et al. have reported in the previous literature that in addition to an electron emitting, a light emitting is observed by the passage of electric current through the device after the A-forming is performed. Bischoff et al. have estimated that a material of the deposition film 103 must be the one which can contain thermoelectron to 4,000 kelvin and in which the material itself can be heated to the temperature exceeding 1,000 kelvin. Based on the estimation, Bischoff et al. have discussed that the deposition film 103 is a carbon film graphitized.

Another example of a planar type MIM device has been reported, for example, by Pagnia et al. in Phys. Stat. Sol. (a) 108 (1988) 11, the entire contents of which are incorporated herein by reference. In a device of Pagnia et al., a ratio of an emission current to an electric current (device current) inputted to the device, i.e., the emission efficiency is extremely small and on the order of $10^{-6}$, a voltage-current curve thereof indicates a VCNR characteristic (Voltage-Controlled Negative Differential Resistance characteristic) as shown in FIG. 2.

A surface conductive type device has a structure similar to a planar type MIM device and one example thereof has been reported, for example, in Japanese Unexamined Patent Publication No. 11-297192. In the manufacturing processes of the surface conductive type device, as similarly to the planar type MIM device previously described, an electrically discontinuous section is formed in a thin film by the step which is referred to as a forming, and a material containing carbon is deposited on the thin film by the step which is referred to as an activation. Differently from the afore-mentioned planar type MIM device, a surface conductive type device, for example, described in Japanese Unexamined Patent Publication No. 11-297192 does not have the VCNR characteristic as shown in FIG. 3 but does exhibit a monotonously increasing type voltage-current curve. Moreover, an emission efficiency of the surface conductive type device is on the order of $10^{-3}$ and is higher that of the planar type MIM device. With regard to this feature, the surface conductive type device and the planar type MIM device are characteristically different from each other.

As described above concerning with a planar type MIM device, in a planar type electron emitting device, a portion nearby the electron emitting section becomes in extremely a high temperature. Therefore, in a planar type electron emitting device, a thin film functions as an electron emitting section is easily degenerated, therefore, the characteristic of the device may be deteriorated with time. Therefore, in a planar type electron emitting device, it is desired that the long term stability is enhanced.

Moreover, in the case where the planar type electron emitting devices are applied to a display, a voltage drop more or less occurs, and the voltage drop becomes more prominent when a large number of pixels on the identical wiring are lighted at the same time by line-sequential drive. In the case where an emission efficiency of each device is low, the voltage drop becomes significantly large, and as a result, unevenness of luminance occurs. Therefore, it is desired for a planar type electron emission device to be capable of realizing a higher electron emission efficiency.

Thus, it is desired for a conventional planar type electron emitting device to enhance the long term stability and electron emission efficiency, that is, it is desired for it to enhance the device characteristic.

BRIEF SUMMARY OF THE INVENTION

An object of the present invention is to provide a planar type electron emitting device capable of realizing a more excellent device characteristic and a method of manufacturing the same.

According to a first aspect of the present invention, there is provided an electron emitting device, comprising a substrate, a pair of electrodes formed on the substrate and being apart from each other, a pair of electrically conductive films formed on the electrodes, respectively, and being apart from each other, a distance between the electrically conductive films being shorter than a distance between the electrodes, and an electron emitting film formed between the electrically conductive films, the electron emitting film containing boron and at least one of carbon and nitrogen.

According to a second aspect of the present invention, there is provided a method of manufacturing an electron emitting device, comprising forming a pair of electrodes apart from each other on a substrate, forming a pair of electrically conductive films apart from each other on the electrodes, respectively, a distance between the electrically conductive films being shorter than a distance between the electrodes, and forming an electron emitting film containing boron and at least one of carbon and nitrogen between the electrically conductive films.

In the device according to the first and second aspect of the present invention, the electron emitting device contains boron as an essential ingredient and further contains either one of carbon and nitrogen.

As the substrate, for example, an insulating substrate, high-resistance substrate and the like can be employed. The electrically conductive films may be thinner than the electrodes.

In the case where the electron emitting film contains boron and carbon, boron may be bonded to carbon in the film. Moreover, in the case where the electron emitting film contains boron and carbon, a molar ratio of carbon and boron contained in the film may be in a range of, for example, 3:1 to 10000:1. Furthermore, in the case where the electron emitting film contains boron and carbon, a material thereof may partially form a graphite-like layer structure whose lattice spacing d(002) is smaller than 0.35 nm.

In the case where the electron emitting film contains boron and nitrogen, in the electron emitting film, a ring structure of boron and nitrogen may be contained. Moreover, in the case where the electron emitting film contains boron and nitrogen, a molar ratio of boron and nitrogen contained in the film may be in a range of 2:1 to 1:2. Furthermore, in the case where the electron emitting film contains boron and nitrogen, the film may further contain at least one element selected from the group consisting of magnesium, aluminum, silicon, phosphorus and sulfur.

In the case where the electron emitting film contains boron, carbon and nitrogen, in at lease one portion of the film, boron, carbon and nitrogen may be phase-separated into a phase containing boron nitride and a phase containing carbon.

A deposition method can be utilized for forming the electron emitting film.

For example, the formation of the electron emitting film may comprise depositing a material containing boron and carbon between the electrically conductive films while causing a current to flow between the electrodes in an atmosphere containing at least one of a compound which comprises boron and carbon and a mixture of a compound which comprises boron and a compound which comprises carbon. In this case, the above-described atmosphere may contain at least one species selected from the group consisting of alkyl borane, allyl borane, vinyl borane, aryl borane and substitution products thereof.

Or else, the formation of the electron emitting film may comprise depositing a material containing boron and nitrogen between the electrically conductive films while causing a current to flow between the electrodes in an atmosphere containing a compound which comprises boron and nitrogen. In this case, the above-described atmosphere may contain at least one species selected from the group consisting of amine borane complex, amino borane and a compound having a ring structure of boron and nitrogen.

Or else, the formation of the electron emitting film may comprise depositing a material containing boron and nitrogen between the electrically conductive films while causing a current to flow between the electrodes in an atmosphere containing a compound which comprises boron and a compound which comprises nitrogen. In this case, the above-described atmosphere may contain at least one species selected from the group consisting of amine borane complex, amino borane and a compound having a ring structure of boron and nitrogen. Moreover, in this case, the above-described atmosphere may contain hydrocarbon.

Or else, the formation of an electron emitting film may comprise depositing a material containing carbon between the electrically conductive films while causing a current to flow between the electrodes in a first atmosphere containing a compound which comprises carbon and depositing a material containing boron and nitrogen between the electrically conductive films while causing a current to flow between the electrodes in a second atmosphere containing a compound which comprises boron and nitrogen. The first atmosphere may contain hydrocarbon. Moreover, in this case, the second atmosphere may contain at least one species selected from the group consisting of amine borane complex, amino borane and a compound having a ring structure of boron and nitrogen.

DETAILED DESCRIPTION OF THE INVENTION

Hereinafter, embodiments of the present invention will be described with reference to the drawings. It should be noted that identical reference signs and numerals are attached to similar members in the respective drawings and the overlapped description is omitted.

Figure 1:
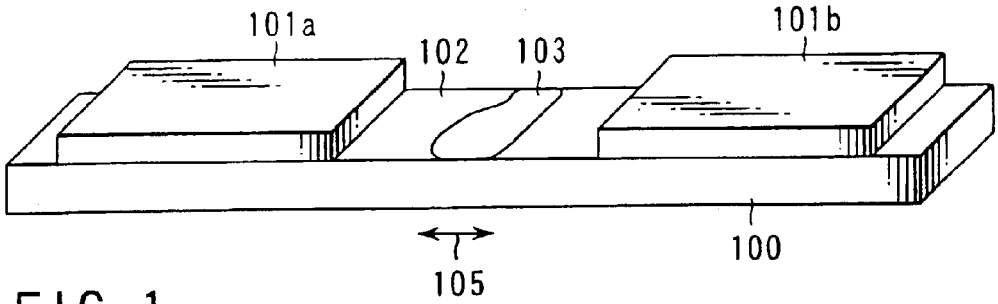
FIG. 1 (PRIOR ART)
FIG. 1 is a perspective view schematically showing a conventional planar type MIM device.
Figure 2:
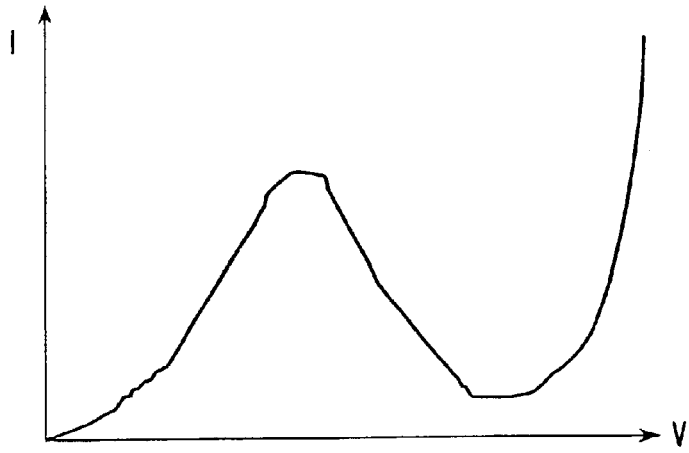
FIG. 2 (PRIOR ART)
FIG. 2 is a graphical representation showing one example of a voltage-current characteristic of the conventional planar type MIM device.
Figure 3:
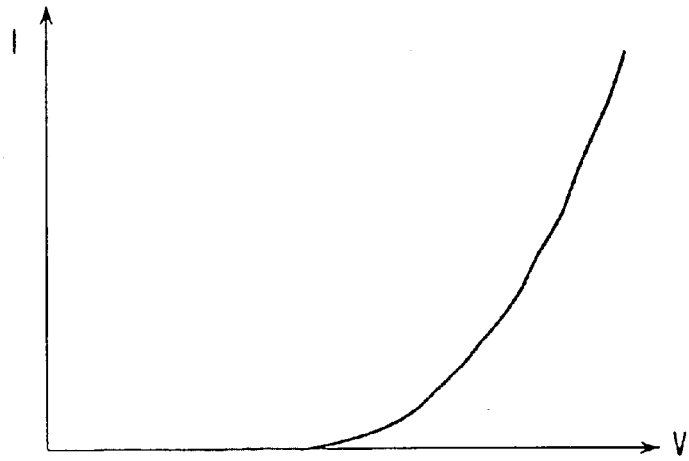
FIG. 3 (PRIOR ART)
FIG. 3 is a graphical representation showing one example of a voltage-current characteristic of a conventional surface conductive type device.
Figure 4A:
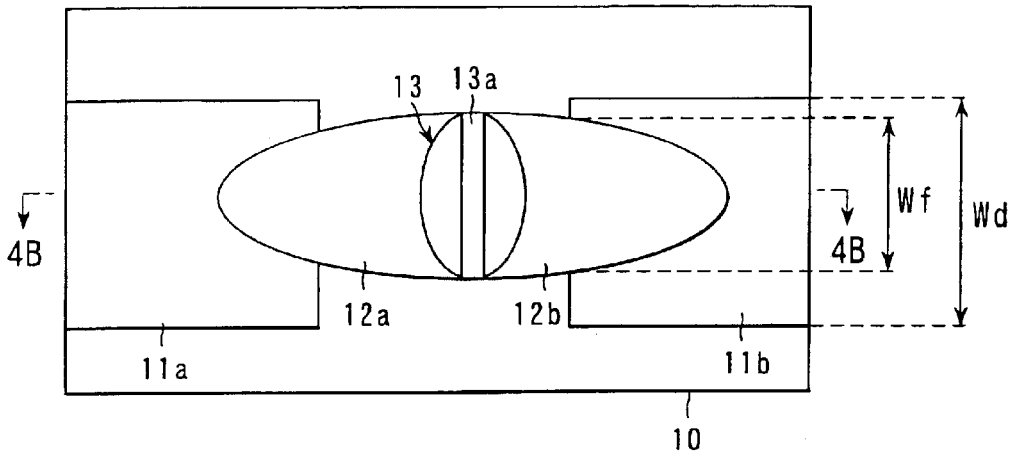
FIG. 4A is a plan view schematically showing a planar type electron emitting device according to a first embodiment of the present invention.
Figure 4B:
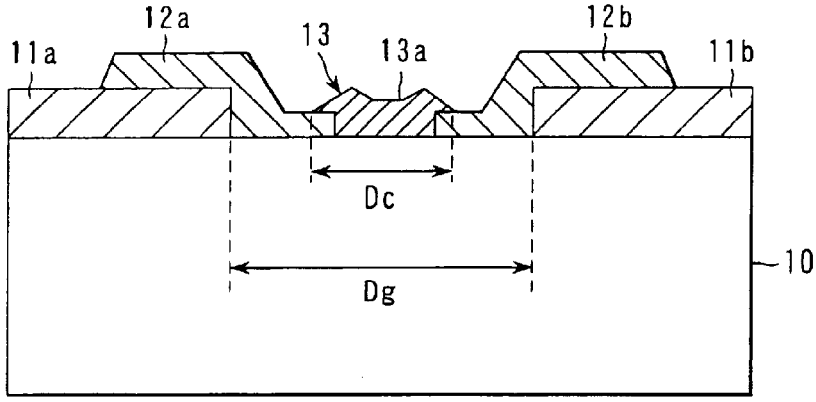
FIG. 4B is a sectional view taken along 4B—4B line of a device shown in FIG. 4A.

FIG. 4A is a planar view schematically showing a planar type electron emitting device according to the first embodiment of the present invention. FIG. 4B is a sectional view taken along 4B—4B line of the device shown in FIG. 4A.

In FIGS. 4A and 4B, the reference numeral 10 denotes an insulating substrate, the reference numerals 11*a* and 11*b* denote electrodes, the reference numerals 12*a* and 12*b* denote electrically conductive films, the reference numeral 13 denotes an electron emitting film deposited between the electrically conductive films 12*a* and 12*b*, and the reference numeral 13*a* denotes an electron emitting section provided in the electron emitting film 13.

As a material for the substrate 10, an insulating material or a high-resistance material can be employed. Therefore, as the substrate 10, it is possible to use, for example, a substrate whose main component is $SiO_2$ such as quartz glass substrate, quartz substrate, sodium glass substrate, soda-lime glass substrate, borosilicate glass substrate, phosphorus glass substrate and the like; an insulating oxide substrate such as $Al_2O_3$ substrate and the like; and an insulating nitride substrate such as AlN substrate and the like. For the selection of the substrate 10, the factors such as economical efficiency, productivity and the like may be considered. Moreover, the substrate 10 whose dielectric strength is $10^7$ V/cm or more is preferable. For this reason, it is desirable that mobile ion species such as $Na^+$ ion and the like have been previously removed from the surface region thereof. Therefore, in the case where a substrate containing mobile ions such as a sodium glass substrate is employed, a diffusion preventing layer such as SiN layer or the like may have been formed on its surface and further a surface layer such as $SiO_2$ film may have been formed thereon.

As a material for the electrodes 11*a* and 11*b*, a material selected from an electrically conductive metal, a semiconductor and semi-metal material can be employed, preferably, transition metal with a high electrical conductivity and a high oxidation resistance is employed. As the material for the electrodes 11*a* and 11*b*, for example, Ni, Au, Ag, Pt, Ir and the like are preferable. The electrodes 11*a* and 11*b* are usually formed in a thickness of the order of a few tens of nm to a few $\mu$m. In general, if each of the electrodes 11*a* and 11*b* has such a thickness, a sufficient electrical conductivity can be obtained. Moreover, the electrodes 11*a* and 11*b* are preferably formed in a uniform thickness, and it is preferable that peeling, floating and curling of the film exist as little as possible.

As a film forming method utilized for forming the electrodes 11*a* and 11*b*, for example, a vacuum deposition method, a plating method, a method of precipitating an electrically conductive material from a colloidal liquid and the like can be employed. In the case where the adherence of a film obtained by such a method to the substrate 10 is poor, it is preferable that a concave and convex structure with nanometer scale has been previously formed on the surface of the substrate 10 or an adherent layer has been formed between the substrate 10 and the film. In order to form the electrodes 11*a* and 11*b*, a combination of the above-described film forming technology and a photolithography technology, a combination of the above-described forming film technology and a lift off process, a mask evaporation method, a screen printing method, an offset printing method and the like can be employed, and it is preferable to employ a method in which curling is not easily occurred at the end portion of the film.

The width Wd of the electrodes 11*a* and 11*b* and the width Wf of the electrically conductive films 12*a* and 12*b* can be determined by a required rate of an emission current and an occupying area allowed for the device. Usually, the width Wf is narrower than the width Wd, and the width Wd can be, for example, 1 mm. Moreover, an interval Dg between the electrodes 11*a* and 11*b* can be appropriately set, for example, within the range of a few tens of nm to a few tens of $\mu$m. The interval Dg can be determined based on a patterning method capable of being utilized and the factors such as the tolerance of a characteristic variation between the devices.

The electrically conductive films 12*a* and 12*b* provide a slit narrower than the distance between the electrodes 11*a* and 11*b*, between the electrodes 11*a* and 11*b*. In addition, the electrically conductive films 12*a* and 12*b* function as a underlayer for deposition of the electron emitting film 13.

As a material for the electrically conductive films 12*a* and 12*b*, similar to the electrodes 11*a* and 11*b*, a metal, a semi-metal, and a semiconductor can be employed. It is preferable that each of the electrically conductive films 12*a* and 12*b* is formed as thin as possible without making the films discontinuous while keeping an electrical conductivity thereof. As the material of the electrically conductive films 12*a* and 12*b*, it is particularly preferable that a transition metal used for a catalyst such as Ni, Co, Fe, Pd, Au, Pt, Ir and the like are employed, but not limited to these. The electrically conductive films 12*a* and 12*b* are usually obtained by applying a voltage between the electrodes 11*a* and 11*b* after these are formed as a continuous film of the predetermined size. The continuous film is partially fused and destructed by such a processing and forced to be discontinuous. It should be noted that as a film forming method utilized for forming the above-described continuous film, a vacuum deposition method such as a sputtering method, CVD (Chemical Vapor Deposition) method, MBE (Molecular Beam Epitaxy) method, laser ablation method and the like; a precipitation method of precipitating an electrically conductive material from a plating solution and colloidal solution; a self-organized film precipitation method using a metal/semiconductor ultra-fine grain whose surface is stabilized by an organic molecule such as alkane thiol or the like can be utilized.

In FIGS. 4A and 4B, the electron emitting film 13 is formed on the electrically conductive films 12*a* and 12*b*, respectively, and within the slit between the films 12*a* and 12*b*, and electrically connected to the electrically conductive films 12*a* and 12*b*. The width Dc of the electron emitting film 13 is usually extremely narrow as being a few nm.

The electron emitting section 13*a* is a portion of the electron emitting film 13. The electron emitting section 13*a* is, for example, a portion having a higher resistance comparing with those of the peripheral portions. Such a high resistance section can be formed, for example, by providing a crack in the electron emitting film 13 or by differentiating the components of a portion of the electron emitting film 13 from the components of its peripheral portions. It should be noted that in the case where a crack is provided in the electron emitting film 13, the crack may be the one which completely divide the electron emitting film 13, or the one which incompletely divide the electron emitting film 13.

In the electron emitting device according to the present embodiment, the electron emitting film 13 contains carbon and boron. The electron emitting device employing such a structure is significantly excellent in the long term stability of the device characteristic compared with that of the device not containing boron as the main component. This mechanism has not sufficiently illuminated, however, in general, it is known that carbon fiber containing boron is high in oxidation resistance, and it is estimated that this contributes to the enhancement of the long term stability also in the present embodiment. It should be noted that the electron emitting film 13 may have a laminated structure obtained by laminating thin films different in component from each other. In this case, it is preferable that at least uppermost film of the thin films contains carbon and boron.

In the present embodiment, it is preferable that boron contained in the electron emitting film 13 is bonded to carbon. Moreover, it is preferable that a molar ratio of carbon and boron contained in the electron emitting film 13 is in the range of 3:1 to 10000:1, it is more preferable that it is in the range of 5:1 to 100:1. Furthermore, it is preferable that at least a portion of boron and carbon bonding to each other exists as crystal or microcrystal in the electron emitting film 13, and the crystal or microcrystal forms a graphite-like layer structure whose lattice spacing d(002), that is, a lattice spacing in the c axis direction is smaller than 0.35 nm. A more excellent long term stability can be realized by such a configuration.

In the second embodiment, one example of a manufacturing process for the electron emitting device according to the first embodiment will be described. Hereinafter, an apparatus used for forming the electron emitting film 13 in the present embodiment and a manufacturing process for the electron emitting device according to the present embodiment will be in turn described below.

Figure 5:
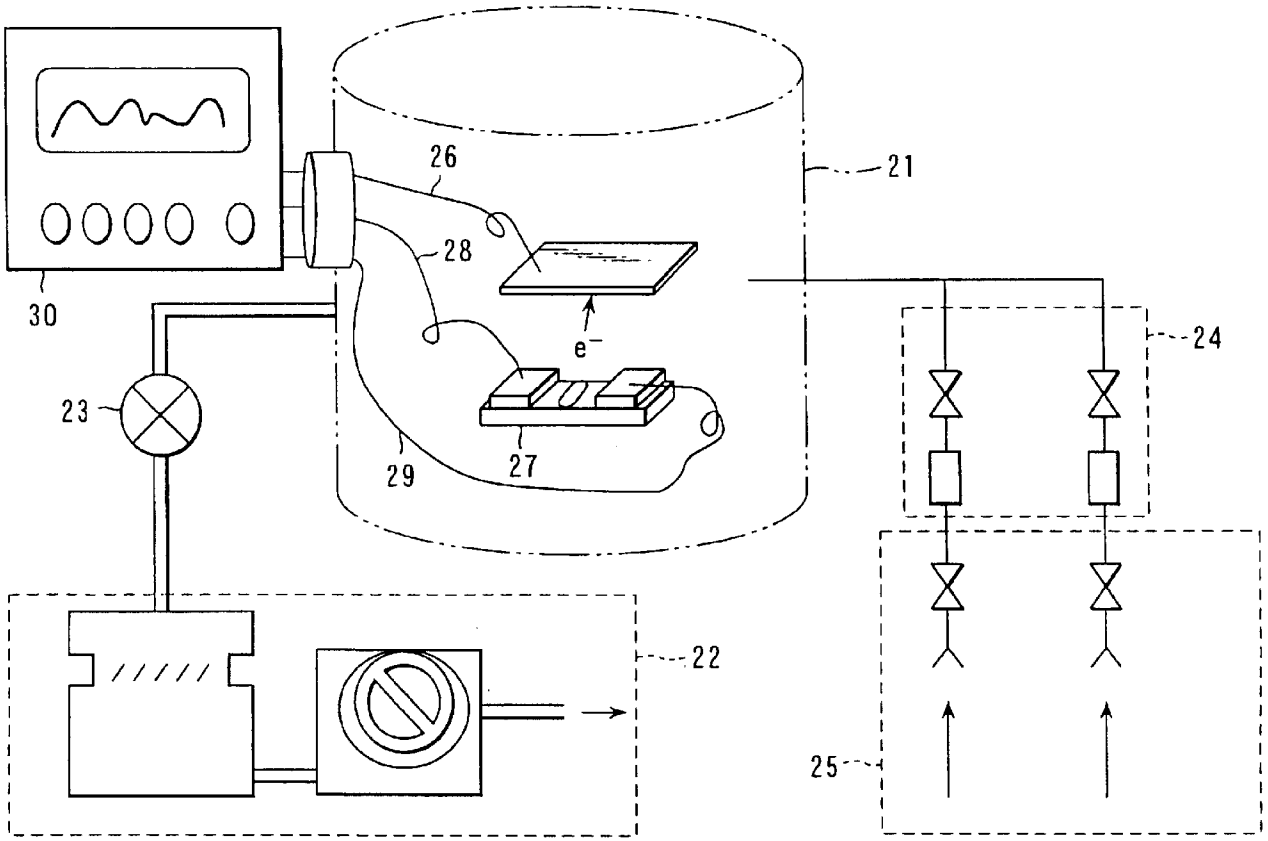
FIG. 5 is a schematic diagram showing an apparatus utilized in a manufacturing process according to a second embodiment of the present invention.

FIG. 5 is a schematic diagram showing an apparatus used for a manufacturing process according to the second embodiment of the present invention. In FIG. 5, the reference numeral 21 denotes a vacuum container, the reference numeral 22 denotes an exhaust system, the reference numeral 23 denotes a gate valve, the reference numeral 24 denotes a flow-rate adjustment section, the reference numeral 25 denotes a raw material gas supply system, the reference numeral 26 denotes a wiring connected to anode, the reference numeral 27 denotes the electron emitting device shown in FIGS. 4A and 4B, and the reference numerals 28 and 29 denote wirings connected to the electrodes of the (−) side and the (+) side, respectively. Each of the wirings 26, 28 and 29 is connected to the voltage application/measurement section 30.

As the vacuum container 21, a metal chamber used for a conventional vacuum apparatus can be employed. The lowest pressure achieved in the vacuum container 21 is preferably equal to or less than $10^{-5}$ Pa, and it is particularly preferable that it is equal to or less than $10^{-8}$ Pa. Moreover, as for the exhaust system 22, it is preferable that the system is free from oil, and, for example, the combination of at least two of a magnetic levitation turbo molecular pump, diaphragm pump, scroll pump, ion pump, titanium sublimation pump, getter pump, adsorption pump and the like can be used.

The raw material gas supply system 25 has a container containing a raw material, a container temperature adjustment mechanism for adjusting vapor pressure of the raw material, a primary pressure adjustment mechanism for the raw material gas and the like. Even if the raw material within the container is any form of gas, liquid or solid, the container temperature and the primary pressure can be appropriately adjusted. This raw material gas supply system may be a supply system in which a plurality of the supply systems are arranged in parallel so as to be capable of supplying a plurality of raw material gases at the same time.

A raw material supplied by the raw material gas supply system 25 contains a compound having boron or a compound having boron and carbon. As such a compound, for example, halogen borane such as boron trifluoride ($BF_3$), boron trichloride ($BCl_3$), boron tribromide ($BBr_3$), and boron triiodide ($BI_3$); borane represented by the general formula $B_nH_{2n+2}$ such as diborane ($B_2H_6$), tetraborane ($B_4H_{10}$); carborane such as o-carborane ($C_2B_{10}H_{12}$) can be employed. Furthermore, out of the above-described compounds, in the case where a compound not containing carbon is used, it is preferable to supply a material containing carbon such as hydrocarbon and the like at the same time. Alternatively, after a material containing carbon is supplied for certain hours, the supply is stopped, and subsequently a material containing boron may be supplied.

It is preferable that the raw material supplied by the raw material gas supply system 25 contains any of alkyl borane, aryl borane, vinyl borane, allyl borane or any of alkoxy borane, aryloxy borane, vinyloxy borane, allyloxy borane. Most of these are easy to treat compared with halogen borane and borane from the viewpoints of toxicity and corrosion. As the preferable example of alkyl borane, triethyl borane [$(C_2H_5)_3B$], trimethyl borane [$(CH_3)_3B$] and the like can be listed, and as the preferable example of aryl borane, triphenyl borane [$(C_6H_5)_3B$], cyclophenyl borane [$(C_6H_5)Cl_2B$] in which phenyl group has been substituted with halogen, phenylborate [$(C_6H_5)(OH)_2B$] in which phenyl group has been substituted with OH group and the like can be listed.

As the preferable example of alkoxy borane, triethoxy borane [$(C_2H_5O)_3B$], trimethoxy borane [$(CH_3O)_3B$] and the like can be listed, and as the preferable example of aryloxy borane, triphenyl borate [$(C_6H_5O)_3B$] and the like can be listed.

Next, a manufacturing method of the electron emitting device according to the present embodiment will be described below with reference to FIGS. 6A–6C.

Figure 6A:
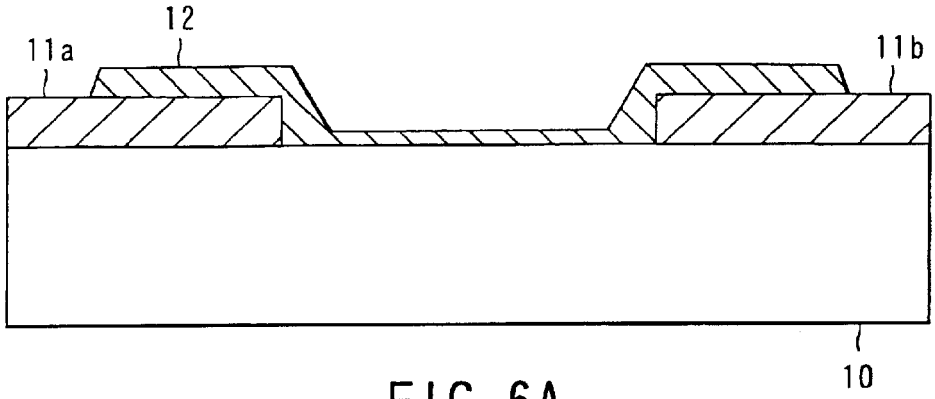
FIGS. 6A–6C are sectional views schematically showing a manufacturing process according to the second embodiment of the present invention.
Figure 6B:
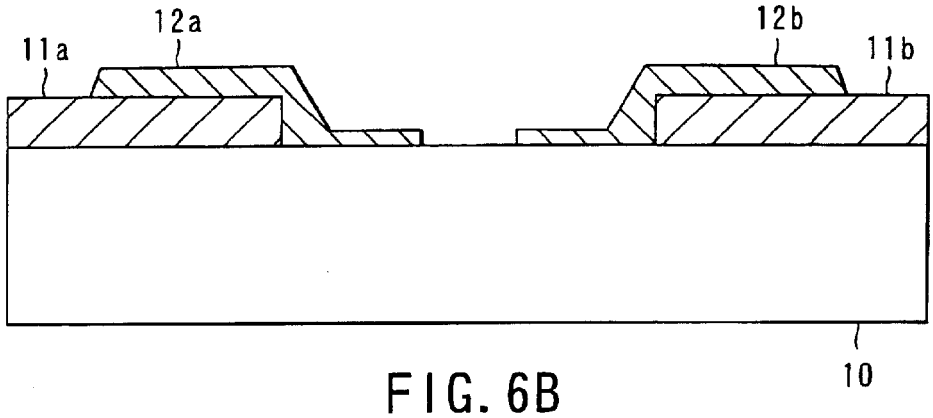

First, as shown in FIG. 6A, the substrate 10 on which the electrodes 11*a* and 11*b* and a electrically conductive film 12 are formed is mounted within the vacuum container 21 of the apparatus shown in FIG. 5. At the moment, the electrically conductive film 12 is not divided into the electrically conductive films 12*a* and 12*b*. Then, the wirings 28 and 29 are connected to the electrodes 11*a* and 11*b*, respectively, and the container 21 is exhausted.

Next, a current is caused to flow between the electrodes 11*a* and 11*b* connected by the wirings 28 and 29. Consequently, the electrically conductive film 12 is heated to cause a partial aggregation, thereby producing a discontinuity portion as shown in FIG. 6B. The discontinuity portion is immediately expanded, and divides the electrically conductive film 12 into the portion 12*a* of (+) side and the portion 12*b* of (−) side. As a result, little current flows between the electrodes 11*a* and 11*b*.

Then, a gas which contains a material for the electron emitting film 13 is introduced into the vacuum container 21, the gas pressure within the container 21 is stabilized at certain value by adjusting a flow rate and exhausting rate. The pressure within the vacuum container 21, for example, can be measured using an ion gauge or the like. Moreover, the pressure within the vacuum container 21 can be controlled while monitoring the components of gas species within the vacuum container 21 using a quadrupole mass spectrometer (QMS) or the like. Preferable pressure within the vacuum container 21 is dependent upon the gas used, and usually, the pressure can be set to a value within the range on the order of 10 Pa to on the order of $10^{-6}$ Pa.

Figure 6C:
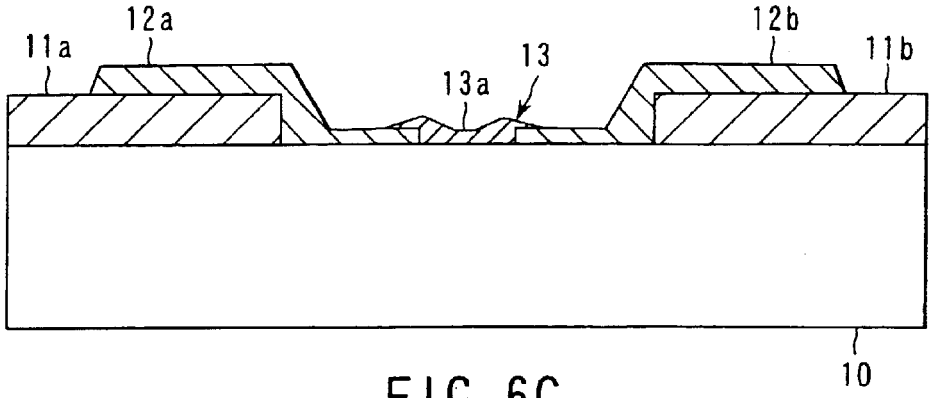

When a current is flow through the device 27 using the voltage application/measurement section 30, a raw material gas is decomposed by the actions of emitted electron, electric field, heat and the like, and as shown in FIG. 6C, the electron emitting film 13 containing boron and carbon is deposited. Then, a portion of the electron emitting film 13 becomes the electron emitting section 13*a*. It is noted that a waveform of the voltage applied by the voltage application/measurement section 30 may be direct current waveform, triangle waveform, rectangular waveform, pulse waveform and the like.

The device current increases as the deposition of the electron emitting film 13 progresses. Application of the voltage between the electrodes 11*a* and 11*b* is terminated after the device current sufficiently increases. The time when the application of voltage is to be terminated can be determined on the basis of current rate required by the device, a voltage-current characteristic and the like.

After the deposition of the electron emitting film 13 is completed, a new deposition is suppressed and the characteristic thereof is stabilized by sufficiently removing the residual raw material gas. It should be noted that the step in which the depositing the material on the electrically conductive films may be repeated a plurality of times, and may be performed so that the thin films whose components are different from each other are laminated.

Next, the third embodiment of the present invention will be described below. An electron emitting device according to the present embodiment has a structure similar to a device according to the first embodiment except that the components of the electron emitting film 13 are different.

In the device according to the third embodiment, the electron emitting film 13 contains boron and nitrogen. A high electron emitting efficiency can be realized by the electron emitting device employing such a structure.

In the present embodiment, the electron emitting film 13 preferably contains boron-nitrogen bond. Moreover, it is preferable that molar ratio of boron and nitrogen contained in the electron emitting film 13 is in the range of 2:1 to 1:2. Particularly, it is preferable that the molar ratio of these is on the order of 1:1. Moreover, it is preferable that the electron emitting film 13 contains boron nitride. In this case, it is particularly preferable that boron nitride has a crystal structure of hexagonal or cubic system, and it is preferable that its grain size is at least equal to or more than 1 nm. Moreover, it is preferable that the device according to the present embodiment is used in the atmosphere containing hydrogen. A higher electron emitting efficiency can be realized by such a configuration.

In the device according to the present embodiment, it is preferable that the electron emitting film 13 further contains any of magnesium, aluminum, silicon, phosphorus, and sulfur, and it is preferable that the rate of contents is equal to or less than 10%. In the case where the electron emitting film 13 contains the third element of these, both of the device current and emission current can be increased.

The device according to the present embodiment, for example, can be fabricated by modifying a portion of the manufacturing process described in the second embodiment. Specifically, as a raw material of the electron emitting film 13, a compound having boron and nitrogen may be used instead of the compound having boron and carbon or the mixture of the compound having boron and the compound having carbon. As the compound having boron and nitrogen, amine borane complex, amino borane, and a compound having a ring structure of boron and nitrogen or the like can be used. As the preferable amine borane complex, for example, ammonium borane complex ($NH_3.BH_3$), triethylamine borane complex [$(C_2H_5)_3N.BH_3$], dimethylamine borane complex [$(CH_3)_2N.BH_3$], pyridine borane complex [$(C_5H_5N).BH_3$], 4-methylpyridine borane complex [$CH_3(C_5H_4N).BH_3$], N'N-diethylaniline borane complex [$(C_6H_5)(C_2H_5)_2N.BH_3$], N'N-diisopropylethylamine borane complex [$(i\text{-}C_3H_7)_2(C_2H_5)N.BH_3$], 2,6-lutidine borane complex [$(CH_3)_2(C_5H_3N).BH_3$] and the like are listed.

As the preferable amino borane, borane amine [$NH_2.BH_2$], trisdimethylamino borane [$(N(CH_3)_2)_3B$], trismethylamino borane [$(NH(CH_3))_3B$] and the like are listed. Furthermore, as the compound having a ring structure of boron and nitrogen, borazine [$H_6B_3N_3$], 1,3,5-trimethyl borazine [$(CH_3)_3N_3H_3B_3$], 2,4,6-trimethyl borazine [$(CH_3)_3B_3H_3N_3$], hexamethyl borazine [$(CH_3)_6B_3N_3$] and the like are preferable.

It should be noted that in the case where at least one of the above-described magnesium, aluminum, silicon, phosphorus, and sulfur is contained in the electron emitting film 13, it is preferable that, when the raw material gas is introduced into the vacuum container, other raw material gases containing these elements are supplied at the same time using supply system separately provided.

As a substance used for the raw material gas containing aluminum, for example, triethyl aluminum [$Al(C_2H_5)_3$], trimethylamine alane complex [$AlH_3.N(CH_3)_3$], triisopropoxy aluminum [$Al(i\text{-}OC_3H_7)_3$] and the like can be listed. As a substance used for the raw material gas containing magnesium, for example, bis-cyclopentadienyl magnesium [$Mg(C_5H_5)_2$], bis-methylcyclopentadienyl magnesium [$Mg(CH_3C_5H_4)_2$], and the like can be listed. As a substance used for the raw material gas containing phosphorus, for example, triethyl phosphorus [$P(C_2H_5)_3$], trimethyl phosphite[$P(OCH_5)_3$], triethyl phosphite [$P(OC_2H_5)_3$] and the like can be listed. As a substance used for the raw material gas containing silicon, for example, tetraethyl silane [$Si(C_2H_5)_4$], tetradimethylamino silane [$Si(N(CH_3)_2)_4$] and the like can be listed. As a substance used for the raw material gas containing sulfur, for example, alkane thiol and thiophene [$H_4C_4S$] such as diethyl sulfur [$S(C_2H_5)_2$] and ethanethiol [$C_2H_5SH$] can be listed.

Next, the fourth embodiment of the present invention will be described below. An electron emitting device according to the present embodiment has a structure similar to the device according to the first embodiment except that the components of the electron emitting film 13 are different.

In the device according to the fourth embodiment, the electron emitting film 13 contains boron, nitrogen and carbon. Both of a high long-term stability and a high electron emitting efficiency can be realized by the electron emitting device employing such a structure.

In the present embodiment, the electron emitting film 13 preferably contains boron-nitrogen bond. Moreover, it is preferable that molar ratio of boron and nitrogen contained in the electron emitting film 13 is in the range of 2:1 to 1:2. Particularly, it is preferable that the molar ratio of these is on the order of 1:1. Moreover, it is preferable that a molar ratio of carbon to whole of the constituting elements in the electron emitting film 13 is equal to or more than 1%. Furthermore, it is preferable that boron, nitrogen and carbon are at least partially phase separated into a phase containing boron nitride and a phase containing carbon in the electron emitting film 13.

The device according to the present embodiment, for example, can be fabricated by modifying a portion of the manufacturing process described in the second embodiment. Specifically, as a raw material for the electron emitting film 13, a mixture of the compound having boron and nitrogen described in the third embodiment and hydrocarbon may be used. In order to form the electron emitting film 13, a raw material gas containing a compound having boron and nitrogen and a raw material gas containing hydrocarbon may be introduced at the same time within the vacuum container 21. Alternatively, driving the device for a certain period of time while introducing the raw material gas containing hydrocarbon into the vacuum container 21, exhausting the container 21, and driving the device for a certain period of time while introducing the raw material gas containing the compound having boron and nitrogen into the vacuum container 21 may be performed.

As the preferable amine borane complex, for example, ammonium borane complex ($NH_3.BH_3$), triethylamine borane complex [$(C_2H_5)_3N.BH_3$], dimethylamine borane complex [$(CH_3)_2N.BH_3$], pyridine borane complex [$(C_5H_5N).BH_3$], 4-methylpyridine borane complex [$CH_3(C_5H_4N).BH_3$], N'N-diethylaniline borane complex [$(C_6H_5)(C_2H_5)_2N.BH_3$], N'N-diisopropylethylamine borane complex [$(i\text{-}C_3H_7)_2(C_2H_5)N.BH_3$], 2,6-lutidine borane complex [$(CH_3)_2(C_5H_3N).BH_3$] and the like are listed.

Moreover, as the preferable amino borane, borane amine [$NH_2.BH_2$], tris-dimethylamino borane [$(N(CH_3)_2)_3B$], trimethylamino borane [$(NH(CH_3))_3B$] and the like are listed. Furthermore, as the compound having the ring structure of boron and nitrogen, borazine [$H_6B_3N_3$], 1,3,5-trimethyl borazine [$(CH_3)_3N_3H_3B_3$], 2,4,6-trimethyl borazine [$(CH_3)_3B_3H_3N_3$], hexamethyl borazine [$(CH_3)_6B_3N_3$] and the like are preferable.

In the above-described embodiments, only a single device has been described, however, by arranging a plurality of devices in a matrix, these can be applied to a planar type display and exposure device. Moreover, materials for the respective sections and manufacturing methods can be modified appropriately according to the specification and the like.

Next, examples of the present invention will be described below.

EXAMPLE 1

By the similar method as described in the second embodiment, plural electron emitting devices (Sample [1]–[6]), each of which has the structure shown in FIGS. 4A and 4B and whose components of the raw material gas utilized for forming the electron emitting film 13 are different from each other, were prepared. It should be noted that in all of the Samples, for the substrate 10, a quartz glass substrate was used, for the electrodes 11*a* and 11*b*, Ir films were used, for the electrically conductive films 12*a* and 12*b*, Au deposition films were used. Moreover, each width of the electrically conductive films 12*a* and 12*b* was 100 μm, the interval Dg between the electrodes 11*a* and 11*b* was 5 μm. In the following Table 1, the components of the raw material gases, the total pressure within the vacuum container 21, the respective time period for applying the voltage to the devices when the electron emitting film 13 was formed, and voltage waveforms are indicated.

TABLE 1

| Sample | Raw material gas | Flow ratio | Total pressure | Time | Waveform |
|---|---|---|---|---|---|
| [1] | $BCl_3 + C_6H_6$ | 9:1 | $133 \times 10^{-3}$ Pa | 10 min | Triangular wave 120 Hz |
| [2] | $Cl_2C_6H_6B + H_2$ | 1:10 | $133 \times 10^{-5}$ Pa | 5 min | Triangular wave 120 Hz |
| [3] | $(C_6H_5)_3B$ | | $133 \times 10^{-6}$ Pa | 5 min | Triangular wave 120 Hz |
| [4] | $(C_2H_5O)_3B$ | | $133 \times 10^{-5}$ Pa | 10 min | Triangular wave 120 Hz |
| [5] | $(C_2H_3)_3B$ | | $133 \times 10^{-6}$ Pa | 5 min | Triangular wave 120 Hz |
| [6] | $C_6H_6$ | | $133 \times 10^{-4}$ Pa | 5 min | Triangular wave 120 Hz |

On the respective Samples [1]–[6] obtained by the above-described method, device current, emission current, efficiency, regulation of device current within certain time period were examined in a state where the electron emitting film 13 and the anode were opposed each other. The results of these are indicated in the following Table 2.

TABLE 2

| Sample | Raw material gas | Device current | Emission current | Efficiency | Current variation |
|---|---|---|---|---|---|
| [1] | $BCl_3 + C_6H_6$ | 1.0 mA | 2.7 μA | 0.27% | 1.8% |
| [2] | $Cl_2O_6H_6B + H_2$ | 1.2 mA | 3.3 μA | 0.28% | 1.5% |
| [3] | $(C_6H_5)_3B$ | 1.5 mA | 3.9 μA | 0.26% | 1.2% |
| [4] | $(C_2H_5O)_3B$ | 0.8 mA | 1.8 μA | 0.23% | 2.1% |
| [5] | $(C_2H_3)_3B$ | 1.1 mA | 3.1 μA | 0.23% | 1.7% |
| [6] | $C_6H_6$ | 1.3 mA | 2.7 μA | 0.21% | 5.0% |

As shown in the above-described Table 2, comparing with Sample [6] using benzene which is a hydrocarbon, in Sample [1]–[5] using a gas having boron, the current variation was suppressed from on the order of ⅕ to on the order of ½, the efficiency was enhanced by on the order of 10% to 30%. Specifically, it was proved that efficiency and characteristic stability of the device were enhanced by using a material containing boron for the electron emitting film 13 shown in FIGS. 4A and 4B. Moreover, the electron emitting film 13 was analyzed by Auger Electron Spectroscopy (AES) and X-ray diffraction method, the results of the values indicated in the following Table 3 were obtained.

TABLE 3

| Sample | Raw material gas | Molar ratio of boron in electron emitting film | d(002) |
|---|---|---|---|
| [1] | $BCl_3 + C_6H_6$ | 2% | 0.345 nm |
| [2] | $Cl_2C_6H_6B + H_2$ | 15% | 0.338 nm |
| [3] | $(C_6H_5)_3B$ | 17% | 0.335 nm |
| [4] | $(C_2H_5O)_3B$ | 0.1% | 0.370 nm |
| [5] | $(C_2H_3)_3B$ | 14% | 0.341 nm |
| [6] | $C_6H_6$ | 0% | 0.382 nm |

As shown in Table 3, the electron emitting film 13 contains boron and carbon in the respective Samples [1]–[5], in Sample [6], the electron emitting film 13 substantially contains carbon only. Moreover, as shown in Table 3, as the molar ratio of boron to carbon in the electron emitting film 13 increased, the lattice spacing d(002) decreased. Furthermore, as it is clear from Tables 2 and 3, d(002) and current regulation correlate to each other, and more stable device characteristic could be realized when d(002) was narrower.

EXAMPLE 2

By the similar method as described in the second embodiment, plural electron emitting devices (Sample [1]–[6]), each of which has the structure shown in FIGS. 4A and 4B and whose components of the raw material gas utilized for forming the electron emitting film 13 are different from each other, were prepared. It should be noted that, in all of the Samples, for the substrate 10, a quartz glass substrate was used, for the electrodes 11*a* and 11*b*, Ir films were used, for the electrically conductive films 12*a* and 12*b*, Au deposition films were used. Moreover, each width of the electrically conductive films 12*a* and 12*b* was 100 $\mu$m, the interval Dg between the electrodes 11*a* and 11*b* was 5 $\mu$m. In the following Table 4, the components of the raw material gases, the total pressure within the vacuum container 21, the respective time period for applying the voltage to the devices when the electron emitting film 13 was formed, and the voltage waveforms are indicated.

TABLE 4

| Sample | Raw material gas | Flow ratio | Total pressure | Time | Waveform |
|---|---|---|---|---|---|
| [7] | $(C_2H_5)_3N \cdot BH_3$ | | $133 \times 10^{-4}$ Pa | 10 min | Triangular wave 120 Hz |
| [8] | $(N(CH_3)_2)_3B$ | | $133 \times 10^{-4}$ Pa | 10 min | Triangular wave 120 Hz |
| [9] | $(C_2H_5)_3N \cdot BH_3 + C_2H_5SH$ | 9:1 | $146 \times 10^{-4}$ Pa | 10 min | Triangular wave 120 Hz |
| [10] | $(N(CH_3)_2)_3B + C_2H_5SH$ | 9:1 | $146 \times 10^{-4}$ Pa | 10 min | Triangular wave 120 Hz |
| [11] | $C_6H_6$ | | $133 \times 10^{-4}$ Pa | 10 min | Triangular wave 120 Hz |

On The respective Samples [7]–[11] obtained by the above-described method, device current, emission current, efficiency, regulation of device current within certain time period were examined in a state where the electron emitting film 13 and the anode were opposed each other. The results of these are indicated in the following Table 5.

TABLE 5

| Sample | Raw material gas | Device current | Emission current | Efficiency | Current variation |
|---|---|---|---|---|---|
| [7] | $(C_2H_5)_3N.BH_3$ | 0.04 mA | 0.13 $\mu$A | 0.32% | 1.2% |
| [8] | $(N(CH_3)_3N.B$ | 0.07 mA | 0.18 $\mu$A | 0.26% | 1.3% |
| [9] | $(C_2H_5)_3N.BH_3 + C_2H_5SH$ | 1.1 mA | 4.5 $\mu$A | 0.41% | 1.8% |
| [10] | $(N(CH_3)_3N.B + C_2H_5SH$ | 1.3 mA | 4.4 $\mu$A | 0.34% | 2.0% |
| [11] | $C_6H_6$ | 1.4 mA | 2.8 $\mu$A | 0.20% | 4.8% |

Moreover, the electron emitting film 13 was analyzed by Auger Electron Spectroscopy (AES). The results are indicated in the following Table 6.

TABLE 6

| Sample | Raw material gas | Carbon | Boron | Nitrogen | Sulfur |
|---|---|---|---|---|---|
| [7] | $(C_2H_5)_3N.BH_3$ | 0% | 52% | 48% | 0% |
| [8] | $(N(CH_3)_3N.B$ | 0% | 50% | 50% | 0% |
| [9] | $(C_2H_5)_3N.BH_3 + C_2H_5SH$ | 0% | 52% | 47% | 1% |
| [10] | $(N(CH_3)_3N.B + C_2H_5SH$ | 0% | 50% | 49% | 1% |
| [11] | $C_6H_6$ | 99% | 0% | 0% | 0% |

As it is clear from the above-described Tables 5 and 6, in both of Sample [7] using triethylamine borane $[(C_2H_5)_3N.BH_3]$ and Sample [8] using tris-diethylamino borane$(N(CH_3)_2)_3B$, comparing with Sample [11] using benzene $[C_6H_6]$, higher efficiencies and excellent stabilities could be realized.

It should be noted that in Samples [7] and [8], the device current and the emission current are decreased by on the order of one figure (=1/10) compared with those in Sample [11]. However, in Samples [9] and [10] in which ethanethiol $[C_2H_5SH]$ was added to the raw material gas, the efficiency was enhanced as well as the device current and emission current were increased.

EXAMPLE 3

By the similar method as described in the second embodiment, plural electron emitting devices (Sample [12]–[18]), each of which has the structure shown in FIGS. 4A and 4B and whose components of the raw material gas utilized for forming the electron emitting film 13 are different from each other, were prepared. Where on Sample [18], after benzene $[C_6H_6]$ was supplied for 5 minutes, pyridine borane $[(C_2H_5)_3N.BH_3]$ was supplied for 5 minutes. Moreover, It should be noted that, in all of the Samples, for the substrate 10, a quartz glass substrate was used, for the electrodes 11*a* and 11*b*, Ir films were used, for the electrically conductive films 12*a* and 12*b*, Au50%-Co50% deposition films were used. Moreover, each width of the electrically conductive films 12*a* and 12*b* was 100 $\mu$m, the interval Dg between the electrodes 11*a* and 11*b* was 5 $\mu$m. In the following Table 7, the components of the raw material gases, the total pressure within the vacuum container 21, the respective time period for applying the voltage to the devices when the electron emitting film 13 was formed, and the voltage waveforms are indicated.

TABLE 7

| Sample | Raw material gas | Flow ratio | Total pressure | Time | Waveform |
|---|---|---|---|---|---|
| [12] | $(C_5H_5N).BH_3$ | | $133 \times 10^{-6}$ Pa | 5 min | Triangular wave 120 Hz |
| [13] | $(C_6H_5)\ (C_2H_5)N.BH_3$ | | $133 \times 10^{-6}$ Pa | 5 min | Triangular wave 120 Hz |
| [14] | $(i\text{-}C_3H_7)_2(C_2H_5)N.BH_3$ | | $133 \times 10^{-6}$ Pa | 5 min | Triangular wave 120 Hz |
| [15] | $(CH_3)_2(C_5H_3N).BH_3$ | | $133 \times 10^{-6}$ Pa | 5 min | Triangular wave 120 Hz |
| [16] | $NH_3\ .BH_3 + C_6H_6$ | 10:1 | $133 \times 10^{-4}$ Pa | 5 min | Triangular wave 120 Hz |
| [17] | $C_6H_6$ | | $133 \times 10^{-4}$ Pa | 5 min | Triangular wave 120 Hz |
| [18] | $C_6H_6 \rightarrow (C_5H_5N).BH_3$ | | $133 \times 10^{-6}$ Pa | 5 min | Triangular wave 120 Hz |

On the respective Samples [12]–[18] obtained by the above-described method, device current, emission current, efficiency, regulation of device current within certain time period were examined in a state where the electron emitting film 13 and the anode were opposed each other. The results of these are indicated in the following Table 8.

TABLE 8

| Sample | Raw material gas | Device current | Emission current | Efficiency | Current variation |
|---|---|---|---|---|---|
| [12] | $(C_5H_5N).BH_3$ | 1.3 mA | 4.0 $\mu$A | 0.31% | 1.1% |
| [13] | $(C_6H_5)\ (C_2H_5)N.BH_3$ | 1.5 mA | 4.4 $\mu$A | 0.29% | 1.5% |
| [14] | $(i\text{-}C_3H_7)_2(C_2H_5)N.BH_3$ | 1.2 mA | 3.1 $\mu$A | 0.26% | 2.6% |
| [15] | $(CH_3)_2(C_5H_3N).BH_3$ | 1.5 mA | 4.1 $\mu$A | 0.27% | 1.0% |
| [16] | $NH_3.BH_3 + C_6H_6$ | 1.3 mA | 3.1 $\mu$A | 0.24% | 3.2% |
| [17] | $C_6H_6$ | 1.4 mA | 2.8 $\mu$A | 0.2% | 5.1% |
| [18] | $C_6H_6 \rightarrow (C_5H_5N).BH_3$ | 1.0 mA | 5.6 $\mu$A | 0.56% | 1.5% |

As shown in Table 8, in the respective Samples [12]–[16] in which the electron emitting film 13 contains boron, carbon and nitrogen, higher efficiencies by on the order of 20% to 50% were obtained and the current variations were suppressed to be on the order of ⅓ to ⅕ compared with Sample [17] in which the electron emitting film 13 contains carbon only. Moreover, in Sample [18], the efficiency was increased by 180% higher than that in Sample [17].

It should be noted that the electron emitting films 13 were analyzed by Auger Electron Spectroscopy (AES) on Sample [12]–[18]. As a result, in Sample [12]–[16], [18], the respective electron emitting films 13 contained carbon, boron and nitrogen. On the other hand, in Sample [17], the electron emitting film 13 consisted essentially of carbon.

Up to this point, as described above, in the present invention, since at least boron and either one of carbon and nitrogen are contained in the electron emitting film, the long term stability and/or electron emission efficiency of the electron emitting film can be enhanced. Therefore, according to the present invention, a planar type electron emitting device capable of realizing an excellent device characteristics and the manufacturing method are provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electron emitting device, comprising:

a substrate;

a pair of electrodes formed on the substrate and being apart from each other;

a pair of electrically conductive films formed on the electrodes, respectively, and being apart from each other, a distance between the electrically conductive films being shorter than a distance between the electrodes; and an electron emitting film formed between the electrically conductive films, the electron emitting film containing boron, nitrogen and at least one element selected from the group consisting of magnesium aluminum, silicon, phosphorus and sulfur.

2. A method of manufacturing an electron emitting device, comprising:

forming a pair of electrodes apart from each other on a substrate;

forming a pair of electrically conductive films apart from each other on the electrodes, respectively, a distance between the electrically conductive films being shorter than a distance between the electrodes; and forming an electron emitting film containing boron and at least one of carbon and nitrogen between the electrically conductive films, wherein the formation of the electron emitting film comprises:

depositing a material containing boron and carbon between the electrically conductive films while causing a current to flow between the electrodes in an atmosphere containing at least one of a compound which comprises boron and carbon and a mixture of a compound which comprises boron and a compound which comprises carbon.

3. The method according to claim 2, wherein the atmosphere contains at least one species selected from the group consisting of alkyl borane, aryl borane, vinyl borane, allyl borane and substitution products thereof.

4. The method according to claim 2, wherein the atmosphere contains at least one species selected from the group consisting of alkoxy borane, aryloxy borane, vinyloxy borane, allyloxy borane and substitution products thereof.

5. A of manufacturing an electron emitting device, comprising:

forming a pair of electrodes apart from each other on a substrate;

forming a pair of electrically conductive films apart from each other on the electrodes, respectively, a distance between the electrically conductive films begin shorter than a distance between the electrodes; and forming an electron emitting film containing boron and at least one of carbon and nitrogen between the electrically conductive films, wherein the formation of the electron emitting film comprises:

depositing a material containing boron and nitrogen on the electrically conductive films while causing a current to flow between the electrodes in an atmosphere containing a compound which comprises boron and nitrogen.

6. The method according to claim 5, wherein the atmosphere contains at least one species selected from the group consisting of amine borane complex, amino borane and a compound having a ring structure of boron and nitrogen.

7. The A method of manufacturing an electron emitting device, comprising:

forming a pair of electrodes apart from each other on a substrate;

forming a pair of electrically conductive films apart from each other on the electrodes, respectively, a distance between the electrically conductive films being shorter than a distance between the electrodes; and forming an electron emitting film containing boron and at least one of carbon and nitrogen between the electrically conductive films, wherein the formation of the electron emitting film comprises:

depositing a material containing boron, nitrogen and carbon between the electrically conductive films while causing a current to flow between the electrodes in an atmosphere containing a compound which comprises boron and nitrogen and a compound which comprises carbon.

8. The method according to claim 7, wherein the atmosphere contains at least one species selected from the group consisting of amine borane complex, amino borane and a compound having a ring structure of boron and nitrogen.

9. The method according to claim 7, wherein the atmosphere contains hydrocarbon.

10. A method of manufacturing an electron emitting device, comprising:

forming a pair of electrodes apart from each other on a substrate;

forming a pair of electrically conductive films apart from each other on the electrodes, respectively, a distance between the electrically conductive films being shorter than a distance between the electrodes; and forming an electron emitting film containing boron and at least one of carbon and nitrogen between the electrically conductive films, wherein the formation of the electron emitting film comprises:

depositing a material containing carbon between the electrically conductive films while causing a current to flow between the electrodes in a first atmosphere containing a compound which comprises carbon; and depositing a material containing boron and nitrogen between the electrically conductive films while causing a current to flow between the electrodes in a second atmosphere containing a compound which comprises boron and nitrogen.

11. The method according to claim 10, wherein the second atmosphere contains at least one species selected from the group consisting of amine borane complex, amino borane and a compound having a ring structure of boron and nitrogen.

12. The method according to claim 10, wherein the first atmosphere contains hydrocarbon.

* * * * *